United States Patent [19]

Zicko

[11] 4,138,051

[45] Feb. 6, 1979

[54] DISPENSER BIN CONTAINER

[75] Inventor: James A. Zicko, Natick, Mass.

[73] Assignee: Container Corporation of America, Chicago, Ill.

[21] Appl. No.: 865,996

[22] Filed: Dec. 30, 1977

[51] Int. Cl.[2] ..... B65D 5/72

[52] U.S. Cl. ..... 229/17 B; 222/457

[58] Field of Search ..... 229/17 B; 222/457, 574; 206/44.12

[56] References Cited

U.S. PATENT DOCUMENTS

| | | | |
|---|---|---|---|
| 2,233,488 | 3/1941 | Powell | 229/17 B |
| 2,340,976 | 2/1944 | Nevins | 229/17 B UX |
| 2,684,792 | 7/1954 | Kraus | 229/17 B X |
| 2,803,390 | 8/1957 | MacKay | 229/17 B |
| 2,847,153 | 8/1958 | Guyer et al. | 229/17 B |
| 3,944,128 | 3/1976 | Hogan | 229/17 B |
| 4,066,205 | 1/1978 | Griffith | 229/17 B |

FOREIGN PATENT DOCUMENTS

| | | | |
|---|---|---|---|
| 1161645 | 3/1958 | France | 229/17 B |

*Primary Examiner*—Davis T. Moorhead
*Attorney, Agent, or Firm*—Carpenter & Ostis

[57] ABSTRACT

A container has a dispenser bin at one of its ends. The side wall of the bin is formed with a retaining tab which is received in a slot in the container to restrict opening of the bin at an angle of less than 90°.

3 Claims, 4 Drawing Figures

DISPENSER BIN CONTAINER

BACKGROUND OF THE INVENTION

Field of the Invention

This invention relates to containers formed primarily from paperboard and, more particularly, to containers having dispenser bins.

The Prior Art

Heretofore containers having dispener bins did not incorporate any means which restricted the opening of the bin to an angle of a certain degree so that the bin could flip back accidentally discharging the contents of the container.

The present invention overcomes the above disadvantage and provides effective means for restricting the opening angle of the bin.

SUMMARY OF THE INVENTION

A container has a dispenser bin at one of its ends. A side of the bin is formed with a retaining tab which is received in a slot in the container to restrict the opening angle of the bin.

DRAWING

Figure 1:
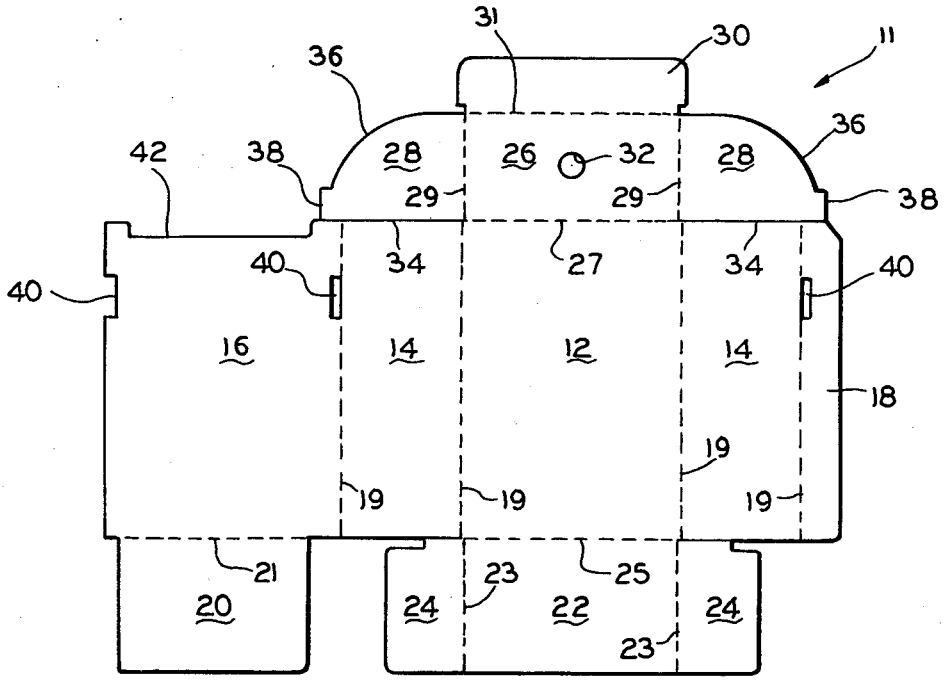
FIG. 1 is a plan view of a blank from which the container of the present invention is formed.
Figure 2:
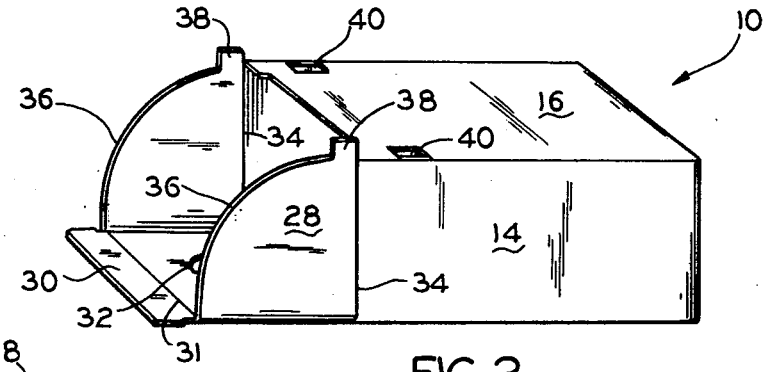
FIG. 2 is a perspective view of a container illustrating the dispenser bin open at an angle of 90°.
Figure 4:
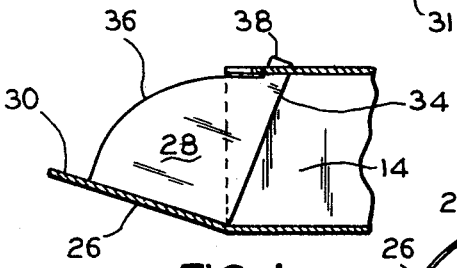
FIG. 4 is a perspective view of a container showing the dispenser bin open at an angle of less than 90°.
Figure 3:
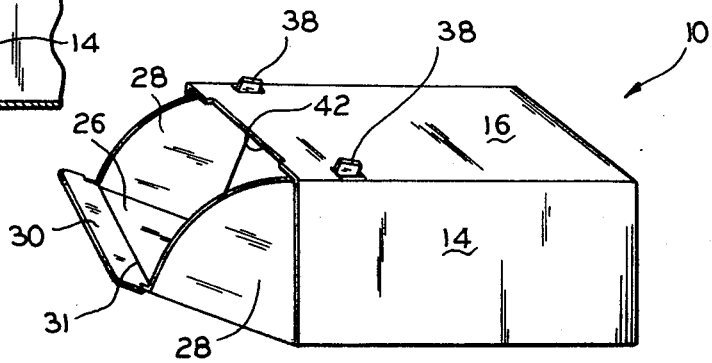
FIG. 3 is a fractional elevational view showing the desired opening angle of the bin.

Referring now to the drawing, there is shown a container 10 formed from a blank 11 of paperboard, or the like.

The container has a bottom wall 12, a pair of side walls 14, a top wall 16 and a glue flap 18 foldably interconnected along fold lines 19 to form a tubular structure.

One end wall of the container is formed from end wall forming panels 20, 22 and 24 by folding the same along the respective fold lines 21, 23 and 25 so as to close one end of the container.

The other end of the container has an end wall forming panel 26 hinged to an edge of the bottom wall 12 along a hinge line 27.

A dispenser bin is formed at this other end of the container and includes said panel 26 having a pair of bin side panels 28 hinged thereto along hinge lines 29. A closure flap 30 is foldably attached to the panel 26 at a fold line 31.

An aperture 32 is formed in the panel 26 to provide a finger receiving opening means for the bin.

Each of the bin side panels 28 has a free inner edge 34 and a free outer edge 36 and together with the hinge line 29 give the side panel a pie-like configuration.

Retaining tabs 38 project from the outer edges 36 and are located adjacent the corners formed by the inner edges 34 and the outer edges 36.

Slots 40 are formed in the top wall 16 and the glue flap 18 along the fold lines 19. The purpose of the slots is to receive and hold the retaining tabs 38 thereby restricting opening of the bin to an angle of less than 90°.

The top wall 16 has an indentation 42 formed at its top to provide easier access to the closure flap 30 when the container is closed.

I claim:

1. A reusable dispenser bin container formed from a cut and scored blank of paperboard, comprising:

(a) foldably interconnected top, side, and bottom major walls forming a tubular structure;

(b) end walls formed from end wall forming panels hingedly attached to end edges of certain of said major walls;

(c) one end wall of said container comprising a dispenser bin formed from one of said end wall forming panels and a pair of bin side panels foldably joined to opposite edges of said end wall forming panel along parallel hinge lines;

(d) said side panels being generally pie shaped and each being defined by one of said hinge lines, a free inner edge extending normal to said one hinge line and a free outer edge extending between said one hinge line and said inner edge;

(e) a retaining tab projecting from said outer edge and being located adjacent a corner formed by said inner edge and said outer edge;

(f) a slot formed in at least one of said major walls adjacent a fold line adjoining said top major wall with one of said side major walls;

(g) said slot receiving said retaining tab to restrict opening of said bin to an angle smaller than 90° relative to the closed position of said end wall.

2. A dispenser bin container as defined in claim 1, wherein said bin is formed with a closure flap.

3. A dispener bin container as defined in claim 2, wherein said closure flap is foldably attached to said end wall forming panel from which said bin is formed.

* * * * *